United States Patent [19]

Langan

[11] 4,060,243

[45] Nov. 29, 1977

[54] COMBINATION CHALK HOLDER AND CUE SLIDE

[76] Inventor: John J. Langan, Box 239, Russell Ave., Frostburg, Md. 21532

[21] Appl. No.: 699,593

[22] Filed: June 24, 1976

[51] Int. Cl.[2] ..... A63D 15/16

[52] U.S. Cl. ..... 273/18

[58] Field of Search ..... 273/18, 17, 19, 20, 273/21; 224/7 R, 28 R, 28 C, 28 D, 28 H, 28 F, 28 W, 45 R, 58; 63/15

[56] References Cited

U.S. PATENT DOCUMENTS

| | | | |
|---|---|---|---|
| 550,302 | 11/1895 | Thompson | 224/28 F |
| 601,779 | 4/1898 | Roberts | 273/18 |
| 639,427 | 12/1899 | McLarty | 273/18 |
| 744,935 | 11/1903 | Peychar | 273/18 |
| 965,444 | 7/1910 | Dahl | 273/18 |
| 1,097,088 | 5/1914 | Gilbert | 273/18 |
| 3,966,101 | 6/1976 | Taylor | 224/28 R |

FOREIGN PATENT DOCUMENTS

| | | | |
|---|---|---|---|
| 15,673 of | 1907 | United Kingdom | 273/18 |

*Primary Examiner*—Harland S. Skogouist
*Assistant Examiner*—T. Brown
*Attorney, Agent, or Firm*—Roylance, Abrams, Berdo & Kaul

[57] ABSTRACT

There is disclosed a combination chalk holder and cue slide adapted to be worn as a ring on the player's finger. The device comprises a band adapted to encircle a finger, the band comprising a means to releasably engage a piece of chalk, means to fasten the ends of the band to form a ring around the finger and a strip of material such as felt which serves as a cue slide.

4 Claims, 8 Drawing Figures

COMBINATION CHALK HOLDER AND CUE SLIDE

This invention relates to a combination chalk holder and cue slide.

It is customary in playing pool and billiards to frequently apply chalk to the end of the cue. This is generally accomplished by the player picking up a cube of chalk and applying it to the end of the cue. In order to render the chalk immediately accessible, no matter where the player is positioned around the pool table, it has been proposed in the past to fit the chalk on the underside of a ring worn by the player. Thus, U.S. Pat. No. 1,097,088 to Gilbert discloses a cue chalk holder which fits on the underside of a ring worn on the player's finger.

It is an object of this invention to provide a combination cue chalk and cue slide to be worn on a player's finger.

It is another object of this invention to provide such a combination on which the cue chalk may be easily replaced.

These, and other objects, are achieved by the practice of this invention which, briefly, comprises a band adapted to encircle a finger, said band comprising means to releasably engage a piece of chalk, means to fasten the ends of said band to form a ring around the finger and a strip of smooth material such as felt which serves as a cue slide.

The invention will now be described more fully by reference to the attached drawings wherein.

Figure 3:
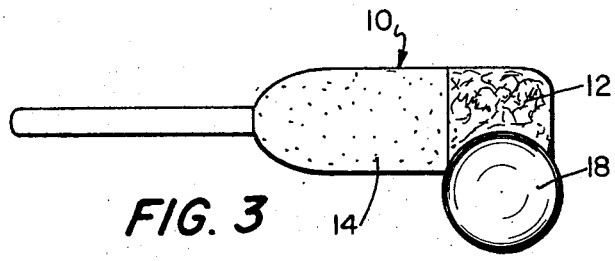
FIG. 3 is a top plan view of a combination chalk holder and cue slide on this invention.
Figure 4:
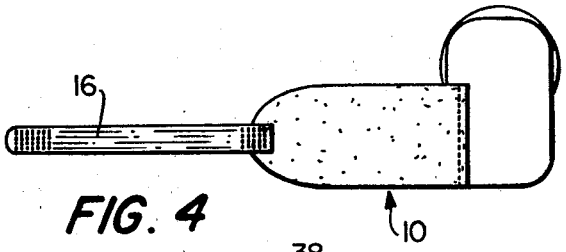
FIG. 4 is a bottom plan view of the device shown in FIG. 3.
Figure 5:
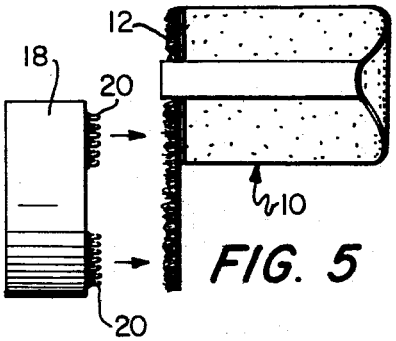
FIG. 5 is a side elevational view of the device shown in FIGS. 3 and 4 in the form of a ring, with the chalk holder broken away.
Figure 6:
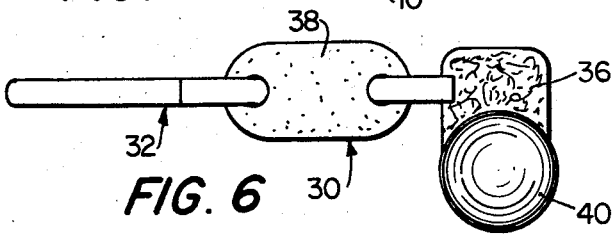
Figure 8:
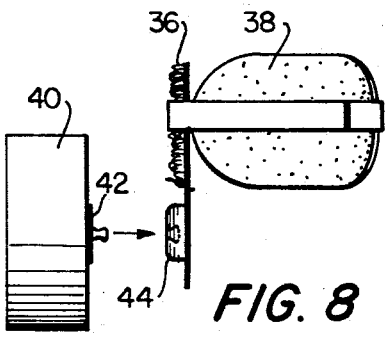
Figure 7:
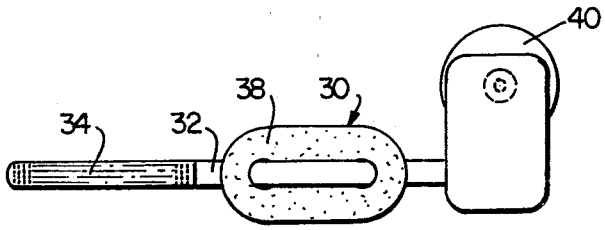

FIGS. 6, 7 and 8 correspond respectively to FIGS. 3, 4 and 5 and illustrate a different embodiment of the means for releasably engaging the chalk.

Figure 2:
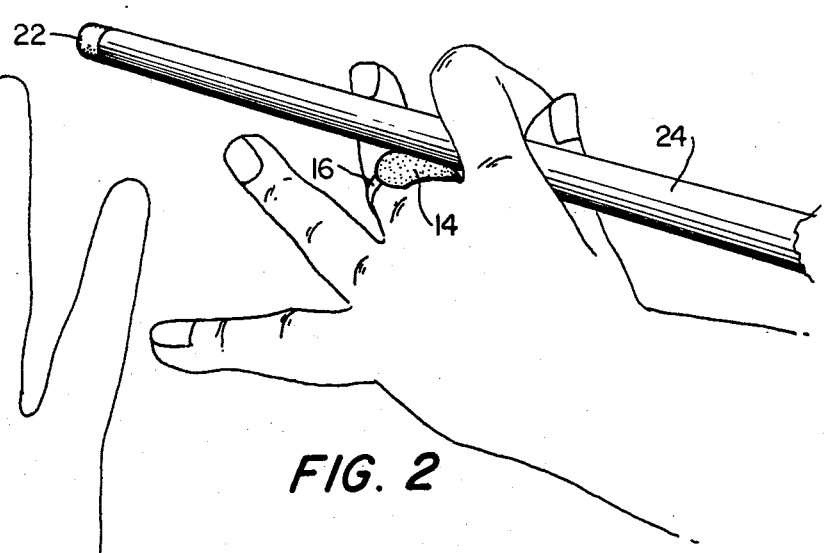
FIG. 2 is a perspective view of a player's hand holding the cue with the cue resting on the cue slide.

Referring to the drawings in greater detail, and more particularly, FIGS. 3, 4 and 5, there is shown a band 10 containing in sequence a patch 12 of Velcro having a large number of loops, a strip of felt 14, and a narrow strip 16 of Velcro hooks. As shown in FIGS. 2 and 3, the Velcro hooks and the Velcro loops are on opposite sides of the band 10. A piece of chalk 18 has secured to the bottom thereof strips 20 having a large number of Velcro hooks. The strips 20 of Velcro hooks serve the purpose of releasably engaging the chalk 18 to the patch of Velcro loops 12. Velcro hooks are of the type which will releasably engage with Velcro loops, such releasable securing mechanism being described in U.S. Pat. No. 3,009,235, the disclosure of which is incorporated herein by reference.

Figure 1:
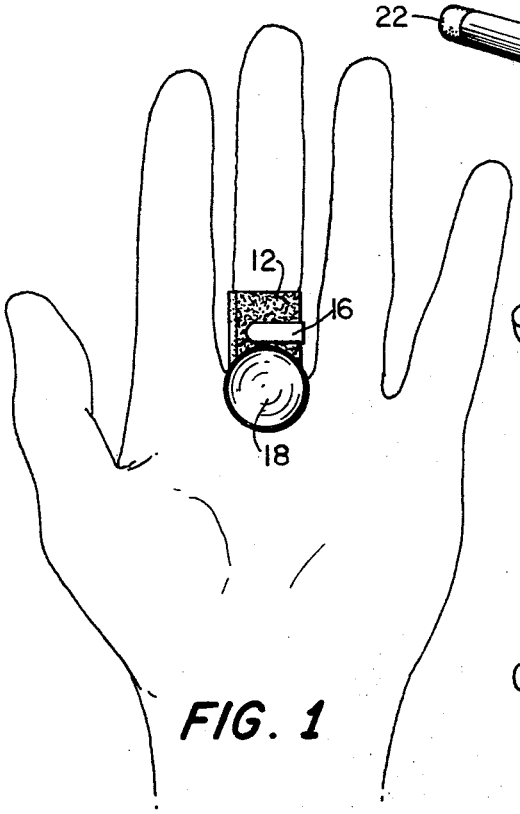
FIG. 1 is an elevational view of a palm of a pool player's hand showing the combination chalk holder and cue slide worn as a ring on a player's middle finger.

FIGS. 1 and 2 show the combination chalk holder and cue slide in place as a ring on the middle finger of a player's hand. The band 10 encircles the finger with the strip of Velcro hooks 16 engaging the patch of Velcro hooks 12 to form a ring. The chalk 18 is also secured to the Velcro patch 12 by means of the strips of Velcro hooks 20. As shown in FIG. 1, the chalk is secured to the band 10 on the palm side of the hand. When the player wishes to chalk his cue, he merely has to place the chalk over the tip 22 of the cue 24. This avoids the necessity for walking around the table to pick up the chalk. As shown in FIG. 2, the felt strip 14 acts as a slide for the cue 24 during the act of shooting. This keeps the cue from coming in contact with perspiration which may form on the player's finger and thus avoids the necessity for using talk or some other adsorbant to keep the cue dry.

FIGS. 6–8 show another embodiment of this invention in which a band 30 includes a long strip 32. On one end of the strip 32 is a portion 34 containing a number of Velcro hooks and on the other end of the strip 32 is a patch 36 of Velcro loops. As previously discussed with reference to FIGS. 2 and 3, the Velcro loops and Velcro hooks are on opposite sides of the strip 32. The strip of Velcro hooks 34 and patch of Velcro loops 36 are adapted to encircle the band around a finger to form a ring as described with respect to FIGS. 2–5. A piece of felt 38 is slidably mounted on the strip 32. This permits easy adjustment of the felt piece 38 to achieve the most desirable placement for shooting. The chalk 40 is secured to the patch of Velcro loops 36 by means of a snap, the male portion 42 of which is secured to the bottom of the chalk 40 and the female portion 44 of which is secured to the patch of Velcro loops 36.

It will be appreciated that many variations may be made from the embodiments shown in the drawings and described hereinabove without departing from the spirit of the invention. Thus, the cue slide 14 and 38 may be felt, Velcro loops or any other suitable material. Moreover, the devices shown in the figures are particularly adaptable to be worn on the left hand. If the player shoots with his left hand, then the device would be worn on the right hand, in which case the chalk and wider portion of the Velcro patch 12 would be placed on the other side of the band 10.

I claim:

1. In combination, a chalk holder and a flexible cue slide band for encircling a finger of a pool or billiards player, said band including a felt material cue slide portion said band further including on one end thereof a strip of narrower width than said cue slide portion, said strip having Velcro hooks on one side thereof, said band further including on the other end thereof a patch of Velcro loops said Velcro hooks and loops being engaged to fasten said band on a player's finger; said chalk holder being releasably attached to said patch by a means to releasably engage said a chalk holder.

2. A device as described in claim 1 wherein said means for releasably engaging said chalk holder comprises Velcro loops on said band and Velcro hooks on said chalk holder.

3. A device as defined in claim 1 wherein said cue slide is slidably mounted on said band to permit relative movement between said slide and said band.

4. A device as described in claim 1 wherein said means for releasably engaging said chalk holder comprises snap fastener having male and female portions.

* * * * *